US012742622B2

(12) United States Patent
Korinis, II et al.

(10) Patent No.: US 12,742,622 B2
(45) Date of Patent: Sep. 22, 2026

(54) MULTI-PART PROJECTILE WITH ANTI-ROTATION COATING

(71) Applicant: Savit Corporation, Rockaway, NJ (US)

(72) Inventors: Nicholas C. Korinis, II, Franklin Lakes, NJ (US); Kenneth R. Jones, Wayne, NJ (US)

(73) Assignee: SAVIT CORPORATION, Rockaway, NJ (US)

( * ) Notice: Subject to any disclaimer, the term of this patent is extended or adjusted under 35 U.S.C. 154(b) by 144 days.

(21) Appl. No.: 18/592,136

(22) Filed: Feb. 29, 2024

(65) Prior Publication Data

US 2025/0314468 A1 Oct. 9, 2025

(51) Int. Cl.
*F42B 12/80* (2006.01)
*C23C 30/00* (2006.01)

(52) U.S. Cl.
CPC ..... *F42B 12/80* (2013.01); *C23C 30/00* (2013.01)

(58) Field of Classification Search
CPC ..... F42B 12/80; F42B 12/76; F42B 12/78; F42B 12/82; F42B 12/02; F42B 12/04; F42B 12/06; F42B 12/08; F42B 12/10; F42B 12/105; F42B 12/12; F42B 12/14; F42B 12/207; F42B 12/208; F42B 12/28; F42B 12/32; F42B 12/36; F42B 12/367; F42B 12/38; F42B 12/40; F42B 12/42; F42B 12/44; F42B 12/46; F42B 12/56; F42B 12/58; F42B 30/02
(Continued)

(56) References Cited

U.S. PATENT DOCUMENTS 1,936,905 A * 11/1933 Gaidos ..... F42B 8/10 102/447
3,910,194 A * 10/1975 Dehm ..... F42B 14/02 102/527

(Continued)

FOREIGN PATENT DOCUMENTS

CA 3000552 C 4/2023

OTHER PUBLICATIONS

"Carbinite's Collet Performance Test", Carbinite Metal Coatings, Retrieved from https://www.carbinite.com/carbinites-collect-performance-test/.

(Continued)

*Primary Examiner* — John Cooper
(74) *Attorney, Agent, or Firm* — Patterson + Sheridan, LLP

(57) ABSTRACT

Described herein are multi-part projectiles that include a high-friction coating as part of an interface between parts of the projectile body. The high-friction coating reduces the probability that projectile parts coupled at the interface would rotate relative as the projectile is launched, thus enhancing the reliability and accuracy of the projectile. In one example, a multi-part projectile includes a projectile body having first and back sections coupled by an interface. The front section has a front land and the back section has a back land. The threaded interface restrains the rotation of the projectile body first and back sections. A high-friction coating is disposed on at least one of the lands of one or both the front and back sections. The high-friction coating has a co-efficient of friction greater than the parent metals against each other alone, without the high-friction coating disposed therebetween.

20 Claims, 3 Drawing Sheets

(58) Field of Classification Search
USPC ..... 102/501, 506, 514, 507–510, 513, 102/515–516
See application file for complete search history.

(56) References Cited

U.S. PATENT DOCUMENTS 4,446,795 A * 5/1984 Price ..... B05D 7/14 102/527
4,532,868 A * 8/1985 Gleichaut ..... F42B 14/02 102/527
4,771,696 A * 9/1988 Smolnik ..... F42B 30/003 102/293
H794 H * 7/1990 Telmo ..... 102/527
5,025,728 A * 6/1991 Marion ..... F42C 1/12 102/271
5,561,262 A * 10/1996 Bartels ..... F42B 12/58 102/357
6,453,821 B1 * 9/2002 Fowler ..... F42B 14/02 102/527
8,286,558 B2 * 10/2012 Marx ..... F42B 14/02 102/527
9,329,004 B2 * 5/2016 Pace ..... F42B 33/001
11,274,908 B2 * 3/2022 Vabnick ..... F42B 12/06
11,300,388 B2 * 4/2022 Nemec ..... F42B 12/76
2005/0034626 A1 * 2/2005 Sanborn ..... F42B 12/34 102/510
2007/0289474 A1 * 12/2007 Mutascio ..... F42B 5/02 102/431
2025/0277654 A1 * 9/2025 Harris ..... F42B 14/06

OTHER PUBLICATIONS

"3M Friction Shims", 3M Technical Data Sheet, Retrieved from https://multimedia.3m.com/mws/media/1001697O/3m-friction-shims.pdf.

* cited by examiner

MULTI-PART PROJECTILE WITH ANTI-ROTATION COATING

FIELD OF THE INVENTION

This invention generally relates to spin-stabilized projectiles of any caliber, and more particularly but not limited to, projectiles having two or more components connect via a threaded or non-threaded interface that includes an anti-rotation coating.

BACKGROUND

Projectiles are often fired using launch pressures exceeding 50,000 pounds per square inch. Spin-stabilized projectiles are commonly fired through a rifled barrel that imparts a spin to the projectile as the projectile is launched. The spin improves flight characteristics, and more importantly, accuracy of the fired projectile. The rotation speed of the projectile accelerates from zero to thousands of revolutions per minute in a few fractions of a second during the firing of the projectile. Such rotational acceleration imparts a large rotational torque on the projectile as the projectile is fired. Typically, this torque is imparted on a rotation band that engraves the rifling of the gun tube. Most often, this rotation band is located at the aft of the projectile. This means that all projectile joints that hold together sections of the projectile forward of the rotation band must be able to survive this torque moment.

Some projectiles have a body made from multiple sections coupled at a joint forward of the rotation band. The joint often includes a threaded interface where the female threads formed on one sections are screwed together with the male threads formed on another section. These threaded interfaces must be robust to endure the compression and high torques experienced during firing. However, robust threaded interfaces are often achieved at the expense of increased sidewall body thickness that adds weight while reducing payload carrying capacity, both of which are undesirable. Thus, projectile designs have to balance increased weight and reduced payload carrying capacity against the strength of the threaded interface. However, desirably reducing weight and increasing payload capacity may undesirably result in some projectiles experiencing shearing or other types threaded connection failure due to compression and high torque present during firing of the projectile. The threads alone are not strong enough to transfer torque from the rotation band located at the aft section of the projectile forward through all other sections of the projectile.

To mitigate the risk of shearing or other types thread failure, projectiles such as projectile that include threaded joints together have traditionally employed knurling at the treaded interface. Knurling has shown to be an effective technique for preventing a surface engaged with a knurled surface from rotating relative to each other. However, with increased firing pressures and other advancements and requirements in projectile design, knurling may not provide sufficient reliability to insure components do not rotate relative to each other while the projectile is fired. This undesirably increases the probability of the failure of the threaded joint, and accordingly, undesirably increases the probability that the projectile will not hit the intended target once fired. Additionally, the tight dimensional control required on the knurling and other features can be difficult to achieve.

Thus, there is a need for a projectile having an improved interface between sections of the projectile body.

SUMMARY

Described herein are multi-part projectiles that include a high-friction coating as part of an interface between parts of the projectile. The high-friction coating reduces the probability that projectile components coupled at the interface would rotate relative as the projectile is launched, thus enhancing the reliability and accuracy of the projectile.

In one example, a multi-part projectile includes a projectile body having first and back sections coupled by an interface. The interface may be threaded or non-threaded. The front section has a front land having an orientation perpendicular to a centerline of the projectile. The back section has a land that has an orientation perpendicular to the centerline. The threaded interface restrains the rotation of the projectile body first and back sections. A high-friction coating is disposed on at least one of the lands of one or both the front and back sections. The high-friction coating has a co-efficient of friction greater than the base materials the projectile is comprised of.

In some examples, the high-friction coating is disposed on the one of the projectile body front section and the projectile body back section has a hardness greater hardness the other of the projectile body front and back sections.

In some examples, the high-friction coating has a co-efficient of friction that is greater than a baseline friction across the joint than the joint would have if the high-friction coating is not present. For example, the co-efficient of friction of the high-friction coating disposed between two abutting surfaces is greater than the baseline co-efficient of friction of the two surfaces when abutting without the high-friction coating present therebetween. The high-friction coating has a safe operating temperature range of that includes between 40 degrees Fahrenheit and 140 degrees Fahrenheit.

In some examples, the high-friction coating has a hardness greater than heat treated alloy steel or aluminum used in the projectile body.

In some examples, the high-friction coating has a surface finish greater than 80 RMS micro inches, such as greater than 240 RMS micro inches.

In some examples, the high-friction coating includes aggregate particles. The aggregate particles may be disposed in a binder. The aggregate particles may be a material selected from the group consisting of tungsten carbide, diamonds, silica, alumina, silicon carbide, carbon boron nitride, and aluminum oxide, among others.

In some examples, the coating may be metallurgically bonded to the base projectile material via welding, plating, hot or cold spray, or electro spark deposition.

In some examples, the high-friction coating is disposed on the back section land.

In some examples, the multi-part projectile of claim rocket fuel disposed in one of the projectile body front section or the projectile body back section; and a detonator positioned to ignite the rocket fuel. In other examples, the multi-part projectile includes a tactical payload disposed in one of the projectile body front section or the projectile body back section.

In some examples, the multi-part projectile may include a protective coating disposed on the projectile body front section and the projectile body back section, the protective coating disposed under the high-friction coating. In other examples, the high-friction coating is deposited on bare metal.

In another example, a multi-part projectile is provided that includes a projectile body having first and second sections coupled by a threaded interface. A tactical payload is disposed in one or both of the projectile body first and second sections. The threaded interface restrains the projectile body first and second sections from rotating relative each other. A high-friction coating is disposed on at least one of the first and second lands. The high-friction coating has a co-efficient of friction greater than the parent alloys against each other with or without knurling.

In yet another example, a multi-part projectile may include a protective coating disposed on the projectile body front section and the projectile body back section, the protective coating disposed under the high-friction coating. In other examples, the high-friction coating is deposited on bare metal.

In yet another example, a multi-part projectile may include a projectile body front section, a projectile body back section, a tactical payload disposed in one or both of the projectile body front and back sections, and an interface coupling the projectile body front and back sections. A rotation band is disposed on one of the projectile body front and back sections. The interface restrains the front and back lands from rotating relative to each other once the lands are in contact with each other. A high-friction coating is disposed on a bare metal of the back land. The high-friction coating has a co-efficient of friction that is greater than a baseline friction across the joint than the joint would have if the high-friction coating is not present. In one example, the high-friction coating has a surface finish greater than 80 RMS micro inches. The high-friction coating may include aggregate particles or material welded to the land.

The multi-part projectile may also include a protective coating disposed on the projectile body front section and the projectile body back section. The protective coating is also disposed over the high-friction coating.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

To facilitate understanding, identical reference numerals have been used, where possible, to designate identical elements that are common to the figures. It is contemplated that elements of one embodiment may be beneficially incorporated in other embodiments.

DETAILED DESCRIPTION

Described herein are multi-part projectiles that include a high-friction coating as part of an interface coupling two separate sections. The interface may be threaded or non-threaded. The high-friction coating may be applied to a surface of one section that contacts the other section once the two sections are secured together to form the interface. The high-friction coating may optionally be applied to the surfaces on each section that contact each other once abutted together. The high-friction coating reduces the probability that projectile parts coupled at the interface would rotate relative to each other or otherwise loosen as the projectile is launched, thus enhancing the reliability and accuracy of the projectile.

Although the disclosed technology is described as embodied in a spin-stabilized projectile, the disclosed technology may be utilized in other threaded and non-threaded connections to prevent undesired rotation therebetween after assembly.

Conventional multi-part projectiles generally use knurling to prevent rotation between sectionals of a multi-part projectiles. The high-friction coating can be used in addition to or as an alternative to conventional knurling or surface texturing. Advantageously, the high-friction coating can be applied directly to a section of a multi-part projectile without expensive post machining (such as knurling), for example directly on the as machined section or on a section that have been coated with a protective layer, such as a corrosion inhibiting epoxy paint. For example, a high-friction coating comprising tungsten carbide has demonstrated an increase in the torque transfer capability between the threaded section of at least twice that of conventionally assembled projectile sections that include knurling.

Figures 1, 3, 4:
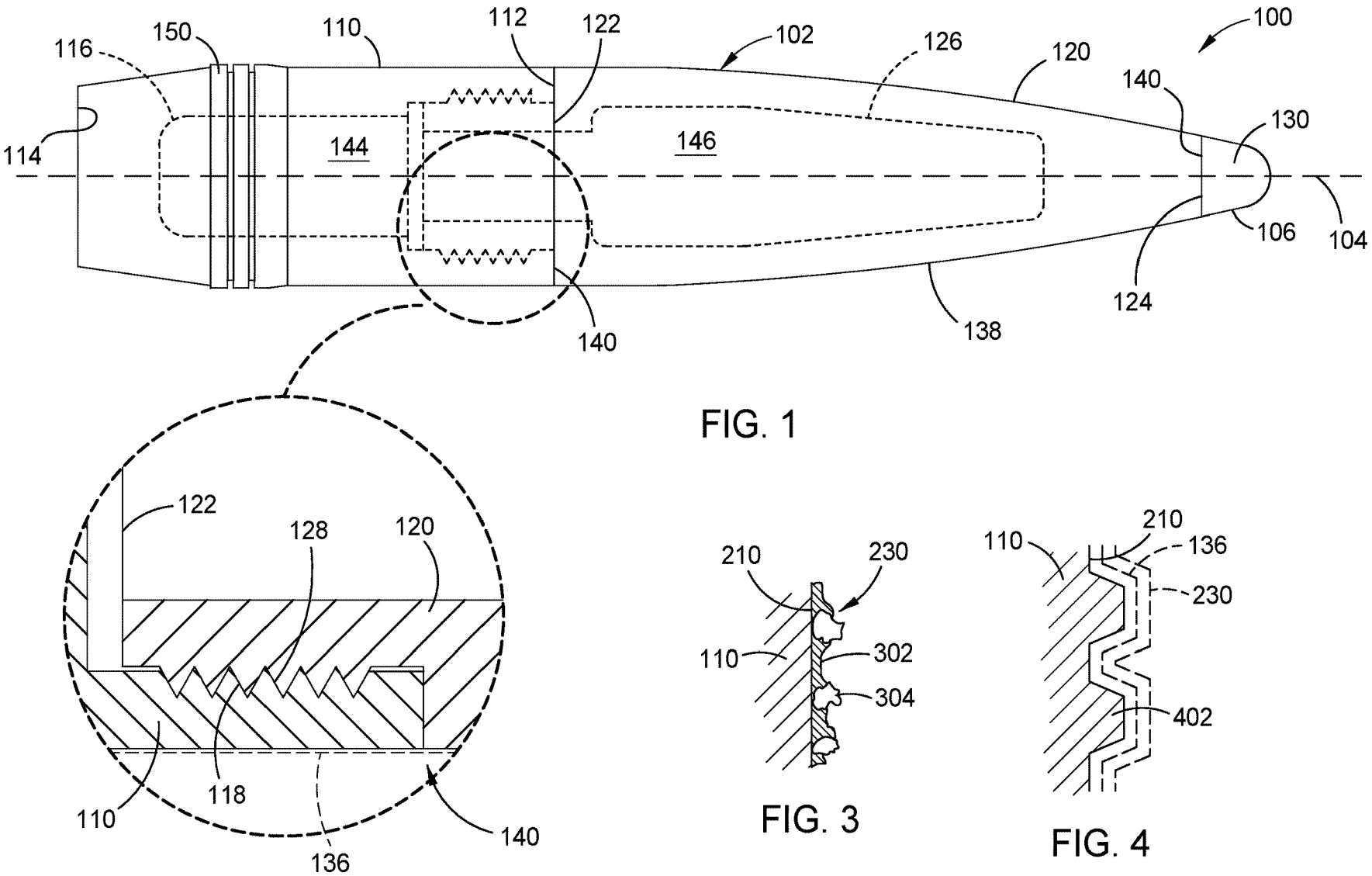
FIG. 1 is a schematic side view of one example of a multi-part projectile having at least two sections coupled via a threaded interface.
FIG. 3 is a sectional view of a portion of a threaded interface illustrating one example of a high-friction coating.
FIG. 4 is a sectional view of a portion of another threaded interface illustrating one example of a high-friction coating.

Turning now to FIG. 1, a side view of a multi-part projectile 100 is illustrated having at least one threaded interface 140 joining at two sections of the projectile 100. It is contemplated that additional one threaded interfaces 140 may be present within the projectile 100. In the example depicted in FIG. 1, two sections of the projectile 100 that are coupled by the threaded interface 140 are a front section 120 and a back section 110.

The projectile 100 generally includes a projectile body 102. The projectile body 102 has a front end 106 and an aft end 114. The projectile body 102 includes a centerline 104 that extends between the front and the aft ends 106, 114 down the middle of the projectile 100. The projectile body 102 may be formed from brass, steel, copper or other suitable material.

As briefly discussed above, the projectile body 102 includes the back section 110 and the front section 120. The centerline 104 of the projectile body 102 is also the centerline 104 of the back section 110 and the front section 120. The aft end 114 of the projectile body 102 defines the aft end 114 of the back section 110. The back section 110 includes a front end 112.

The back section 110 of the projectile body 102 may also include a rotation band 150. The rotation band 150 is fabricated from a soft metal, such as a gilding metal, copper, or lead, among others. When the projectile 100 is fired, the pressure of the propellant swages the metal of the rotation band 150 into the rifling of the barrel and forms a seal. The rotation band 150 thus prevents propellant gases from blowing past the projectile body 102, while engaging the barrel's rifling to spin the projectile 100 for a more accurate flight path. The rotation band 150 may alternative be disposed on the front section 120 of the projectile body 102.

The front section 120 includes an aft end 122 and a front end 124. The front end 112 of the back section 110 is attached to the aft end 122 of the front section 120 via the threaded interface 140. In one example, the front end 124 of the front section 120 defines the front end 106 of the projectile body 102. The front section 120 may optionally be coupled to a warhead 130. When present, the warhead 130 defines the front end 106 of the projectile body 102. The warhead 130 is attached to the front end 124 of the front section 120 with a second threaded interface 140.

The projectile body 102 includes at least one cavity configured to carry a payload. The payload may be any object or fuel carried inside the projectile 100. In one example, the payload is rocket fuel. In another example, the payload is a tactical payload 146, such as a high explosive charge or a canister that can deliver other types of weapons. Other types of tactical payload 146 may be alternatively utilized as commonly known or later developed.

The tactical payload 146 may be carried on the front section 120 and/or back section 110 of the projectile body 102. In the example depicted in FIG. 1, the projectile body 102 includes an aft cavity 116 disposed in the back section 110 and a forward cavity 126 disposed in the front section 120, either or both of which may carry the tactical payload 146. The forward cavity 126 may be isolated from the aft cavity 116 by a bulkhead (not shown), or the cavities 116, 126 may be open to each other. In one example, the tactical payload 146 is disposed in the forward cavity 126 while rocket fuel 144 is located in the aft cavity 116. Detonation of the tactical payload 146 is, in one example, controlled by the warhead 130 fixed to the front end 106 of the projectile body 102. The warhead 130 may include an escapement and ignitor (not shown). When rocket fuel 144 is carried on board the projectile 100, a detonator (not shown) is generally disposed in the projectile body 102 in a positioned to ignite the rocket fuel 144.

The front and back sections 120, 110 of projectile body 102 may optionally include a protective coating 136 on an exterior surface 138 of the projectile body 102. The protective coating 136 generally protects the exterior surface 138 of the projectile body 102. In one example, the protective coating 136 is made from an epoxy or an enamel.

As shown in the enlarged detail of FIG. 1, the threaded interface 140 threadingly couples the front and back sections 120, 110 of projectile body 102. The threaded interface 140 may be oriented perpendicular to the centerline 104 of the projectile body 102. The threaded interface 140 includes a first thread form 128 located near the aft end 122 of the front section 120 and a complimentary second thread form 118 located near the front end 112 of the back section 110. Although in FIG. 1, the first thread form 128 is illustrated as a male thread and the second thread form 118 is illustrated as a female thread, it is contemplated that the first thread form 128 may be a female thread and the second thread form 118 may be a male thread.

Figure 2:
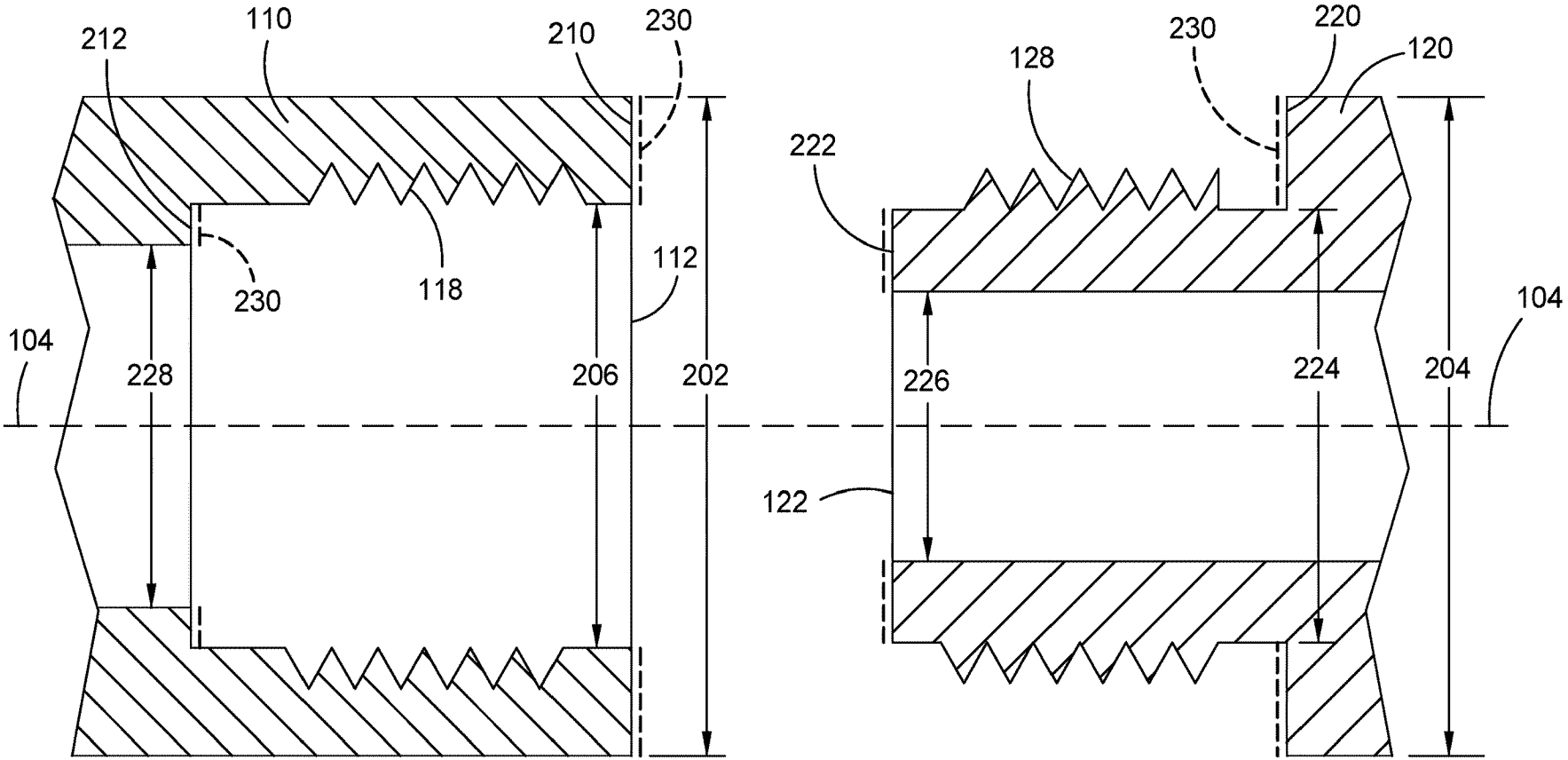
FIG. 2 is an enlarged partial schematic sectional view of one example of a threaded interface that can be used to couple the sections of the multi-part projectile depicted in FIG. 1.

The threaded interface 140 is further detailed in the partial sectional view of FIG. 2. In FIG. 2, the front section 120 of the projectile body 102 has an outer diameter 204. The outer diameter 204 of the front section 120 transitions to a recessed diameter 224 near the aft end 122. The recessed diameter 224 is less than the outer diameter 204. An outer land 220 connects the recessed diameter 224 to the outer diameter 204. The outer land 220 may disposed at any suitable orientation relative to the centerline 104. In the example depicted in FIG. 2, the outer land 220 is oriented perpendicular to the centerline 104. The recessed diameter 224 extends from the outer land 220 to an inner land 222. The inner land 222 also forms the aft end 122 of the front section 120. The inner land 222 may be a solid disk that extends across the aft end 122, or alternatively as shown in FIG. 2, the inner land 222 may terminate at an inner diameter 226 that defines the outer bounds of the forward cavity 126. In one embodiment the inner land 222 has an orientation that is perpendicular to the centerline 104. Alternatively, the inner land 222 may be non-perpendicular with respect to the centerline 104.

A thread form 128 is formed on the recessed diameter 224 between the outer land 220 and the inner land 222 of the front section 120. The thread form 128 illustrated in FIG. 2 is a male thread form that is sized to threadingly engage a complimentary female thread form 118 formed in the aft section 110. As noted above, the thread form 128 may alternatively be a female thread form that engages a complimentary male thread form 118 formed in the aft section 110.

Turning now to the back section 110 of the projectile body 102, the back section 110 has an outer diameter 202 at the front end 112. In one example, the outer diameter 202, at the front end 112 of the back section 110, has the same outside diameter as the portion of the outer diameter 204 closest to the aft end 122 of the front section 120.

The back section 110 includes an outer land 210. The outer land 210 also defines the front end 112 the back section 110. The outer land 210 extends from the outer diameter 202 to a shoulder diameter 206. An orientation of the outer land 210 is complimentary (i.e., resides in parallel planes) to an orientation of the outer land 220 relative to the centerline 104 such that the outer land 210 abuts with outer land 220 when the front and back sections 120, 110 are screwed together across the threaded interface 140. In one example, the orientation of the outer land 220 is perpendicular to the centerline 104. In another example, the orientation of the outer land 220 is non-perpendicular to the centerline 104.

The shoulder diameter 206 extends from the outer land 210 to an inner land 212. The inner land 212 may be a solid disk making the shoulder diameter 206 a blind hole. Alternatively as illustrated in FIG. 2, the inner land 212 extends to at an inner diameter 228 that defines the outer bounds of the aft cavity 116. In one the inner land 222 has an orientation that is perpendicular to the centerline 104. Alternatively, the inner land 222 may be non-perpendicular with respect to the centerline 104. In some examples the orientation of the inner land 222 is parallel to the orientation of the inner land 212 relative to the centerline 104.

In the example depicted in FIG. 2, the inner lands 212, 222 remain spaced apart when the front and back sections 120, 110 are screwed together across the threaded interface 140 to abut the outer land 210 with outer land 220. However, the projectile body 102 may alternatively be configured to have the inner lands 212, 222 abut when the front and back sections 120, 110 are screwed together across the threaded interface 140 such that the outer land 210 and outer land 220 remain spaced apart.

The thread form 118 is formed on the shoulder diameter 206 between the outer land 210 and the inner land 212 of the aft section 110. The thread form 118 illustrated in FIG. 2 is a female thread form that is sized to threadingly engage a complimentary male thread form 128 formed in the front section 120. As noted above, the thread form 128 may alternatively be a female thread form while thread form 118 formed in the aft section 110 may be a female thread form.

When the projectile 100 is launched, significant compressional and rotational forces are exerted on the threaded interface 140. To mitigate the chance that the front and back sections 120, 110 will become screwed or otherwise loosen across the threaded interface 140, at least one or both of the abutting lands 210, 220 and/or at least one or both of the abutting lands 212, 222 includes a high-friction coating 230. The high-friction coating 230 generally increases the baseline co-efficient of friction across the interface 140. Stated differently, the baseline co-efficient of friction across the interface 140 when the high-friction coating 230 is not present in the interface 140 is less than the co-efficient of friction across the interface 140 when the high-friction coating 230 is present in the interface 140. For example, the co-efficient of friction of the high-friction coating 230 disposed between two abutting surfaces (i.e., abutting lands) is greater than the baseline co-efficient of friction of the two surfaces when abutting without the high-friction coating 230 present therebetween. The high-friction coating 230 advantageously inhibits rotation by increasing the friction across the threaded interface 140, and transfers the forces from launch more effectively to the sections 110, 120 of the projectile body 102. As a result, the likelihood of the thread forms 118 and 128 sheering, loosening or otherwise becoming damaged is significantly decreased. For example, projectile bodies 102 having a high-friction coating 230 disposed on one land has demonstrated to have a frictional resistance to unscrewing that is at least twice the frictional resistance of conventional multi-part projectile having only knurling present in the threaded interface. As a result, projectile 100 having a high-friction coating 230 across the threaded interface 140 are significantly more reliable than conventional projectiles, and accordingly, are more likely to fly on the planned trajectory and strike the indented target.

As mentioned above, the high-friction coating 230 can be applied to one land of an abutting pair of lands, or to both lands of an abutting pair of lands. The high-friction coating 230 may be metallurgically bonded to the base projectile material via welding, plating, hot or cold spray, or electro spark deposition, among other techniques. Depending on the choice of high-friction coating 230, the high-friction coating 230 may be applied to the land by brushing, screen printing, flame spray, plasma spray, arc spray, or other suitable technique. The high-friction coating 230 may be applied on an as machined surface (such as a milled or turned surface having a standard average surface roughness (Ra) of 3.2 μm (125 μin) or less) that is not textured. The high-friction coating 230 may applied on a bare, uncoated surface, or alternatively over the protective coating 136. The high-friction coating 230 may applied on a textured or an untextured surface, or alternatively over the protective coating 136. The high-friction coating 230 (or at least the abrasive particles in the high-friction coating 230) generally has a hardness greater than the material comprising the land facing the high-friction coating 230 across the threaded interface. In another example, the high-friction coating 230 (or at least the abrasive particles in the high-friction coating 230) has a hardness greater than the material comprising both lands abutting in the threaded interface 140. Stated differently, the high-friction coating 230 (or at least the abrasive particles in the high-friction coating 230) present on one of the two sections 110, 120 generally has a hardness greater than the material comprising the other of the two sections 110, 120 into which the high-friction coating 230 embeds when sections 110, 120 are tightened together across the threaded interface 140. In another example, the high-friction coating 230 (or at least the abrasive particles in the high-friction coating 230) has a hardness greater than the material comprising both sections 110, 120 of the projectile body 102.

The properties of the high-friction coating 230 may be selected to enhance friction in the threaded interface 140. For example, the high-friction coating 230 has a co-efficient of friction greater than 0.5, such as greater than 0.7 based on the coating 230 being disposed against a land fabricated from alloy steel in a typical heat treat condition and finish suitable for projectile use. Additionally, the high-friction coating 230 has a safe operating temperature range of at least −40 degrees Fahrenheit to about 140 degrees Fahrenheit. Further, the high-friction coating 230 may have a Brinell hardness greater than 130 BHN. The high-friction coating 230 may have a surface finish greater than 80 RMS micro inches. In one example, the high-friction coating 230 has a surface finish greater than 240 RMS micro inches.

FIG. 3 is a sectional view of a portion of the threaded interface 140 illustrating one example of the high-friction coating 230. In the non-limiting example of FIG. 3, the high-friction coating 230 may include abrasive particles 302 entrained in a binder 304. The abrasive particles 302 may be formed from a material selected from the group consisting of tungsten carbide, titanium carbide, diamonds, silica, alumina, silicon carbide, carbon boron nitride, and aluminum oxide, among others. The binder 304 may be an epoxy, hot melt, enamel, silicone-based adhesive, cyano-acrylate adhesive or other suitable binder. In one example, the abrasive particles 302 are comprised of tungsten carbide and/or titanium carbide. In other examples, the high-friction coating 230 may alternatively be a metallurgically bonded coating such as tungsten carbide, titanium carbide or other suitable material that has a rough surface texture that bites into and grips the opposing surface, creating friction and resisting rotation between the abutting body sections.

FIG. 4 is a sectional view of a portion of another threaded interface that can be used in the projectile shell 100 of FIG. 1. The portion of threaded interface shown in FIG. 4 is illustrated as formed on the back section 110, but may formed on any of the lands 210, 220, 212, 222 illustrating one example of a high-friction coating. In FIG. 4, the land 210 is shown with having a textured surface 402. The textured surface 402 is formed on the machined flat surface of the land 210. The textured surface 402 is formed by physical deformation or removal of material from the flat surface of the land 210. Examples of physical deformation or removal of the flat surface of the land 210 include shot blasting, embossing, knurling, machining grooves, and grinding among others. In the example depicted in FIG. 4, the land 210 includes a textured surface 402 formed by knurling (i.e., the textured surface 402 is a knurled surface).

The high-friction coating 230 is deposited on the textured surface 402. In the example depicted in FIG. 4, the protective coating 136 is disposed between the textured surface 402 and the high-friction coating 230. Alternatively, the high-friction coating 230 is deposited directly on the textured surface 402 without an intervening coating.

In projectiles that have sections connected via non-threaded interfaces, rotational motion between the sections is also undesirable. As such, a high-friction coating 230 may also be beneficially utilized in such non-threaded interfaces as further described below to substantially prevent rotation between the sections, making the projectile much more robust, accurate and reliable, with little incremental cost to the projectile.

Figure 5:
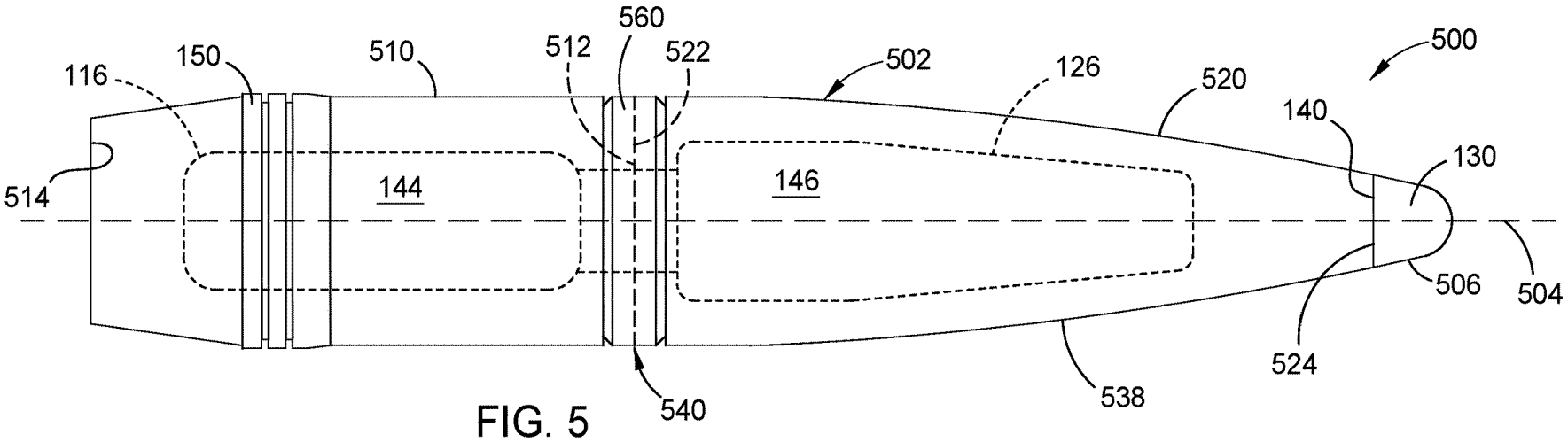
FIG. 5 is a schematic side view of one example of a multi-part projectile having at least two sections coupled via a non-threaded interface.

FIG. 5 is a schematic side view of one example of a multi-part projectile 500 having at least two sections of a projectile body coupled via a non-threaded interface 540. The multi-part projectile 500 is generally the same as the multi-part projectile 100 described above, except for the details of the non-threaded interface 540 as further described below.

Generally, the multi-part projectile 500 is illustrated having at least one non-threaded interface 540 joining at two sections of the projectile 500. It is contemplated that additional non-threaded interfaces 540 may be present within the projectile 500. It is also contemplated that one or more non-threaded interfaces 540 and one or more threaded interfaces 140 (such as shown and described above) may be present within the projectile 500. In the example depicted in FIG. 5, two sections of the projectile 500 that are coupled by the non-threaded interface 540 are a front section 520 and a back section 510.

The projectile 500 generally includes a projectile body 502. An exterior surface 538 of the projectile body 502 may optionally include a protective coating 136. The projectile body 502 has a front end 506 and an aft end 514. The projectile body 502 includes a centerline 504 that extends between the front and the aft ends 506, 514 down the middle of the projectile 500. The projectile body 502 may be formed from the same materials as the projectile body 102. The aft end 514 of the projectile body 502 defines the aft end 514 of the back section 510. The back section 510 includes a front end 512. The back section 510 of the projectile body 502 may also include a rotation band 150.

The front section 520 includes an aft end 522 and a front end 524. The front end 512 of the back section 510 is attached to the aft end 522 of the front section 520 via the non-threaded interface 540. In one example, the front end 524 of the front section 520 defines the front end 506 of the projectile body 502. The front section 520 may optionally be coupled to a warhead 130. When present, the warhead 130 defines the front end 506 of the projectile body 502. In one example, the warhead 130 is attached to the front end 524 of the front section 520 with a threaded interface 140.

The projectile body 502 includes at least one cavity configured to carry a payload as described above. In FIG. 5, the payload is a tactical payload 146, such as a high explosive charge or a canister that can deliver other types of weapons. The tactical payload 146 may be carried on the front section 520 and/or back section 510 of the projectile body 502. In the example depicted in FIG. 5, the projectile body 502 includes an aft cavity 116 disposed in the back section 510 and a forward cavity 126 disposed in the front section 520, either or both of which may carry the tactical payload 146. In one example, the tactical payload 146 is disposed in the forward cavity 126 while rocket fuel 144 is located in the aft cavity 116.

Figure 6:
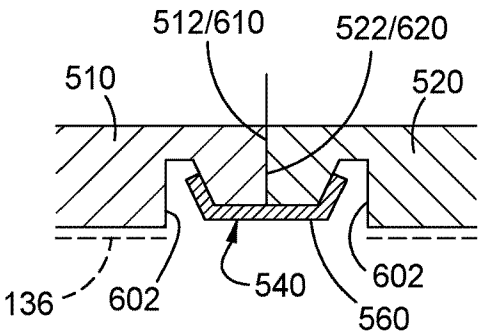
FIG. 6 is a sectional view of a portion of the non-threaded of FIG. 5.

As shown in FIG. 5 and the enlarged detail of FIG. 6, a clamp ring 560 of the non-threaded interface 540 couples the front and back sections 520, 510 of projectile body 502. The clamp ring 560 is generally a band that may be tightened around a flange or notch 602 formed in the sections 520, 510 of projectile body 502 near the ends 512, 522. The clamp ring 560 may be a split ring tightened by fasteners, or a solid band of material that is press fit, shrink fit, swaged, or otherwise secured to the sections 520, 510 of projectile body 502 in a manner that firmly abuts lands 610, 620, defined at the ends 512, 522, tightly together. In the example depicted in FIGS. 5-6, the clamp ring 560 is a metal band that is swaged in the notches 602 formed in each section 520, 510 of projectile body 502. The swaging of the clamp ring 560 compresses the lands 610, 620 defined on the ends 512, 522 tightly against each other.

Figure 7:
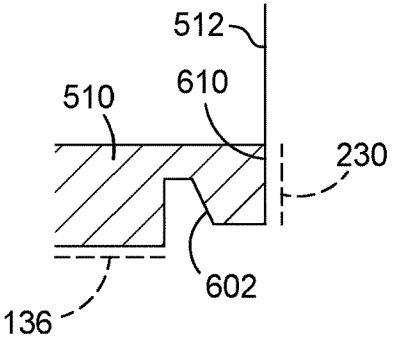
FIG. 7 is a sectional view of a portion of the non-threaded interface of FIG. 6 illustrating one example of a high-friction coating.

When the projectile 500 is launched, significant compressional and rotational forces are exerted on the non-threaded interface 540. To mitigate the chance that the front and back sections 520, 510 will rotate relative each other or otherwise loosen across the non-threaded interface 540, at least one or both of the abutting lands 610, 620 includes the high-friction coating 230, as shown in FIG. 7. The high-friction coating 230 advantageously inhibits rotation by increasing the friction across the non-threaded interface 540, and transfers the forces from launch more effectively to the sections 510, 520 of the projectile body 502. As a result, the likelihood of the sections 510, 520 of the projectile body 502 loosening or otherwise becoming damaged is significantly decreased.

The high-friction coating 230 may be applied on an as machined surface that is textured or not textured. The high-friction coating 230 may applied on a bare, uncoated surface, or alternatively over the protective coating 136 (as shown in FIG. 4). The high-friction coating 230 may applied on a textured surface 402 (as also shown in FIG. 4), with or without an underlying protective coating 136.

Thus, multi-part spin-stabilized projectiles have been disclosed which utilize a high-friction coating to mitigate rotation and other movement between the sections of the projectile. In one example, the high-friction coating provides a reliable threaded interface between the front and back sections of the projectile. In another example, the high-friction coating provides a reliable non-threaded interface between the front and back sections of the projectile. In either example, the high-friction coating more effectively transfers launch forces to the outer walls of the projectile body rather than across the interface joining the abutting sections of the projectile. As a result, the projectile has improved reliability and is more likely to travel its desired trajectory and deliver its payload accurately to an intended target.

What is claimed is:

1. A multi-part projectile comprising:

a projectile body front section having a front section land, the front section land having an orientation perpendicular to a centerline of the multi-part projectile;

a projectile body back section having a back section land, the back section land having an orientation perpendicular to a centerline of the multi-part projectile;

a threaded interface coupling the projectile body front section to the projectile body back section, the interface restrained from rotation in a first direction by contact of the front section land with the back section land; and a high-friction coating disposed on at least one of the front and back section lands, the high-friction coating increasing a baseline co-efficient of friction across the front section land and the back section land.

2. The multi-part projectile of claim 1, wherein the high-friction coating is disposed on the one of the projectile body front section and the projectile body back section having a lower hardness.

3. The multi-part projectile of claim 1, wherein the high-friction coating has a co-efficient of friction greater than 0.5, wherein the land opposing the land on which the high-friction coating is disposed is fabricated from a heat treaded alloy steel.

4. The multi-part projectile of claim 1, wherein the high-friction coating has a safe operating temperature range of at least −40 degrees Fahrenheit to about 140 degrees Fahrenheit.

5. The multi-part projectile of claim 1, wherein the high-friction coating has a hardness greater than mild steel.

6. The multi-part projectile of claim 1, wherein the high-friction coating has a surface finish greater than 80 RMS micro inches.

7. The multi-part projectile of claim 1, wherein the high-friction coating has a surface finish greater than 240 RMS micro inches.

8. The multi-part projectile of claim 1, wherein the high-friction coating comprises tungsten carbide and/or titanium carbide.

9. The multi-part projectile of claim 1, wherein the high-friction coating comprises aggregate particles disposed in a binder.

10. The multi-part projectile of claim 1, wherein the high-friction coating is disposed on the back section land.

11. The multi-part projectile of claim 1 further comprising:

rocket fuel disposed in one of the projectile body front section or the projectile body back section; and a detonator positioned to ignite the rocket fuel.

12. The multi-part projectile of claim 1 further comprising:

a tactical payload disposed in one of the projectile body front section or the projectile body back section.

13. The multi-part projectile of claim 1 further comprising:

a protective coating disposed on the projectile body front section and the projectile body back section, the protective coating disposed under the high-friction coating.

14. The multi-part projectile of claim 1, wherein the high-friction coating is deposited on bare metal.

15. A multi-part spin-stabilized projectile comprising:

a projectile body first section having a first land;

a projectile body second section having a second land;

a rotation band disposed on one of the projectile body first and second sections;

a tactical payload disposed in one or both of the projectile body first and second sections;

a threaded interface coupling the projectile body first and second sections, the threaded interface restrained from rotation in a first direction by contact of the first and second lands; and a high-friction coating disposed on at least one of the first and second lands, the high-friction coating increasing a baseline co-efficient of friction across the first and second lands.

16. The multi-part projectile of claim 15, wherein the high-friction coating has a hardness greater than a hardness of a material comprising first and second lands.

17. The multi-part projectile of claim 16, wherein the high-friction coating comprises tungsten carbide and/or titanium carbide.

18. The multi-part projectile of claim 15, wherein the high-friction coating has a co-efficient of friction greater than 0.5, wherein the land opposing the land on which the high-friction coating is disposed is fabricated from alloy steel in a typical heat treat condition and finish suitable for projectile use; and wherein the high-friction coating has a surface finish greater than 80 RMS micro inches.

19. A multi-part projectile comprising:

a threaded interface coupling first and second components of the multi-part projectile, the first component having a male threadform and an adjacent non-threaded first surface, the second component having a female threadform and an adjacent non-threaded second surface, the components restrained from rotation in a first direction by contact of the first surface with the second surface; and a high-friction coating disposed on at least one of the first and second surfaces, the high-friction coating having a co-efficient of friction that increases a baseline co-efficient of friction across the surfaces.

20. The multi-part projectile of claim 19, wherein the high-friction coating has a surface finish greater than 80 RMS.

* * * * *